United States Patent [19]

Arakawa et al.

[11] Patent Number: 4,664,829

[45] Date of Patent: May 12, 1987

[54] LUBRICATING OIL BLEND RESISTANT TO IONIZING RADIATION

[75] Inventors: Kazuo Arakawa; Naohiro Hayakawa; Kenzo Yoshida; Naoyuki Tamura, all of Takasaki; Hiroshi Nakanishi, Kyoto; Tetsuya Yagi, Ibaraki; Shintaro Kuroiwa, Funabashi, all of Japan

[73] Assignees: Japan Atomic Energy Research Institute, Tokyo; Matsumura Oil Research Corporation, Hyogo, both of Japan

[21] Appl. No.: 720,242

[22] Filed: Apr. 5, 1985

Related U.S. Application Data

[63] Continuation-in-part of Ser. No. 556,164, Nov. 29, 1983, abandoned.

[30] Foreign Application Priority Data

Dec. 1, 1982 [JP] Japan ..... 57-210750

[51] Int. Cl.[4] ..... C10M 105/08

[52] U.S. Cl. ..... 252/52 R

[58] Field of Search ..... 252/52 R

[56] References Cited

U.S. PATENT DOCUMENTS

| | | | |
|---|---|---|---|
| 3,006,852 | 10/1961 | Barnum et al. | 252/52 R |
| 3,130,162 | 4/1964 | Johnson | 252/52 R |
| 3,203,997 | 8/1965 | Mahoney et al. | 252/52 R |
| 3,231,499 | 1/1966 | Smith | 252/52 R |
| 3,290,249 | 12/1966 | Wilson | 252/52 R |
| 3,429,816 | 2/1969 | Giolito et al. | 252/52 R |
| 3,471,574 | 10/1969 | Hammann et al. | 252/52 R |
| 3,647,752 | 3/1972 | Gieseking et al. | 252/484 X |
| 3,704,277 | 11/1972 | Clark | 252/52 R |
| 3,860,661 | 1/1975 | Hammann et al. | 252/52 R |

FOREIGN PATENT DOCUMENTS

| | | | |
|---|---|---|---|
| 654195 | 12/1962 | Canada | 252/52 R |
| 920509 | 3/1963 | United Kingdom | 252/52 R |

*Primary Examiner*—William R. Dixon, Jr.
*Assistant Examiner*—Cynthia A. Prezlock
*Attorney, Agent, or Firm*—Browdy and Neimark

[57] ABSTRACT

An oil blend having resistance to ionizing radiation comprising the following components is herein disclosed:

A. 25 to 75 wt % of 0–70 wt % of o-(m-phenoxyphenoxy)diphenyl and 100–30 wt % of m-(m-phenoxyphenoxy)diphenyl; and B. 75 to 25 wt % of a monoalkyldiphenyl ether or dialkyldiphenyl ether.

This oil blend has a pour point of 0° C. or below and has a G-value of 0.1 or lower for the evolution of decomposition gases under irradiation with ionizing radiation. Said ethers have 10 to 20 carbon atoms in the alkyl moiety.

5 Claims, 4 Drawing Figures

LUBRICATING OIL BLEND RESISTANT TO IONIZING RADIATION

This application is continuation-in-part application of U.S. Ser. No. 556,164 filed on Nov. 29, 1983, now abandoned.

BACKGROUND OF THE INVENTION

1. Field of the Invention

The present invention relates to a lubricating oil blend having resistance to ionizing radiation. More particularly, the invention relates to an oil blend resistant to ionizing radiation, comprising a mixture of phenoxyphenoxydiphenyl and a monoalkyldiphenyl ether or dialkyldiphenyl ether. This oil has a pour point of 0° C. or below and has a G-value of 0.1 or lower for the evolution of decomposition gases under irradiation with ionizing radiation. The term "G-value" used here represents the number of gas molecules liberated per 100 eV of absorbed energy in 1 gram of oil.

2. Description of the Prior Art

With the recent rapid increase in the use of machines under irradiation with ionizing radiation, there has arisen a demand for developing lubricating oils that have high resistance to ionizing radiation in addition to the properties possessed by ordinary lubricants. Petroleum base lubricating oils in current use do not meet this requirement. If they are used as lubricants for machines exposed to a high dose rate of radiation, they are soon decomposed to form either a gas or a solid which lacks any lubricating properties. It has also been reported in the art that if much gas is evolved, fire, metallic corrosion and/or vapor lock in the hydraulic system of machines may possibly be caused.

These problems are caused by the decomposition of the lubricant and the resulting increase in viscosity, total acid number and gas evolution. For example, 350 neutral oil has a G-value of 1.4 for the evolution of decomposition gases; when 1,000 ml of this oil is irradiated with 1 MR of gamma rays, it is decomposed to form 290 ml of decomposition gases. The lower the G-value for the evolution of decomposition gases, the more suitable the lubricating oils for use in a radiation field. If they have a G-value of 0.1, their service life can be extended by almost 10 times the life of petroleum-based lubricants. Conventionally, condensed polycyclic aromatic compounds, polyphenyls and polyphenyl ethers are known to have high resistance to ionizing radiation. However, most of these lubricating oils are available as solid or highly viscous liquid at room temperature or have pour points higher than 0° C. Therefore, they cannot be effectively used, especially in winter, without equipping the lubricating system with a heater.

U.S. Pat. No. 3,130,162 discloses o-(m-phenoxyphenoxy)diphenyl which has a melting point of 50°–51° C., and said patent does not disclose said diphenyl to be a lubricating oil resistant to ionizing radiation.

U.S. Pat. No. 3,203,997 discloses aromatic substituted polyethers, such as bis[p-(p-α-cumylphenoxy)-phenyl]ether having radiation-resistant characteristics, but said ether is solid at room temperature and exhibits no compatability with m-(m-phenoxyphenoxy)diphenyl.

U.S. Pat. No. 3,471,574 discloses m-(m-phenoxyphenxoy(biphenyl which has a pour point of 2.5° C., and which can be blended with polyphenyl ether compounds. However, as indicated in U.S. Pat. No. 3,203,997, bis[p-(p-α-cumylphenoxy)phenyl]ether exhibits no compatability with m-(m-phenoxyphenoxy)-diphenyl, so the latter statement is not completely accurate.

In Japanese Patent Laid-Open (Kokai) No. 60598/80, the present inventors showed that a polyphenyl ether mixture containing phenoxyphenoxydiphenyl can be easily produced by reacting an alkali metal salt of a mixture of phenol and phenylphenol with m-dihalogenobenzene in the presence of a copper catalyst under the conditions for the Ullmann reaction. The inventors continued their studies on the resistance of various lubricating oils to radioactive rays and showed that m-(m-phenoxyphenoxy)diphenyl exhibited an extremely high resistance to ionizing radiation applied together with oxygen bubbling [H. Nakanishi, K. Arakawa, N. Hayakawa, S. Machi and T. Yagi; preprint for the 25th Anniversary Tokyo Seminar, Japan Society of Lubrication Engineers, A 24 (1980) 161]. They also showed that the m-(m-phenoxyphenoxy)diphenyl had a G-value of as low as 0.005 for the evolution of decomposition gases under irradiation. However, this oil does not have an adequately low pour point. On the other hand, monoalkyldiphenyl ethers or dialkyldiphenylethers have good properties for use as lubricating oils (i.e. low pour point, high flash point and high viscosity index). They also have high resistance to heat and oxidation. However, as compared with phenoxyphenoxydiphenyl, these ethers are somewhat low in resistance to ionizing radiation as applied in the presence of bubbled oxygen and they have a G-value of 0.4–0.6 for the evolution of decomposition gases.

SUMMARY OF THE INVENTION

Therefore, the primary object of the present invention is to provide a lubricating oil blend that has a pour point below 0° C. before and after irradiation and which has high resistance to ionizing radiation as indicated by a G-value of 0.1 or lower for the evolution of decomposition gases and which has stability in terms of viscosity and total acid number before and after irradiation.

Another object of the present invention is to provide a lubricating oil blend having good lubricating properties and high resistance to ionizing radiation which can be produced from a mixture synergistically comprising specific proportions of phenoxyphenoxydiphenyl and a monoalkyldiphenyl ether or dialkyldiphenyl ether.

Other objects and advantages of the present invention may become apparent to those skilled in the art from the following description and disclosure.

DETAILED DESCRIPTION OF THE INVENTION

Figure 1:
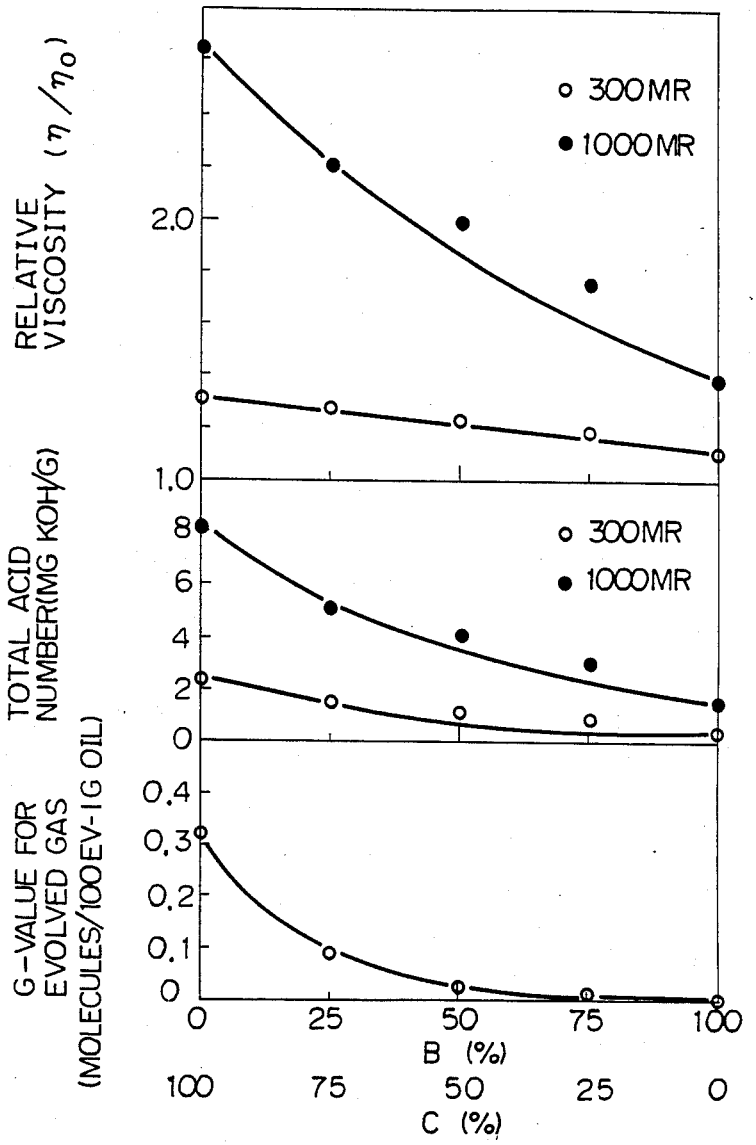
FIG. 1 shows the relationship between Examples 4 to 6 and Comparative Examples 1 and 3.
Figure 2:
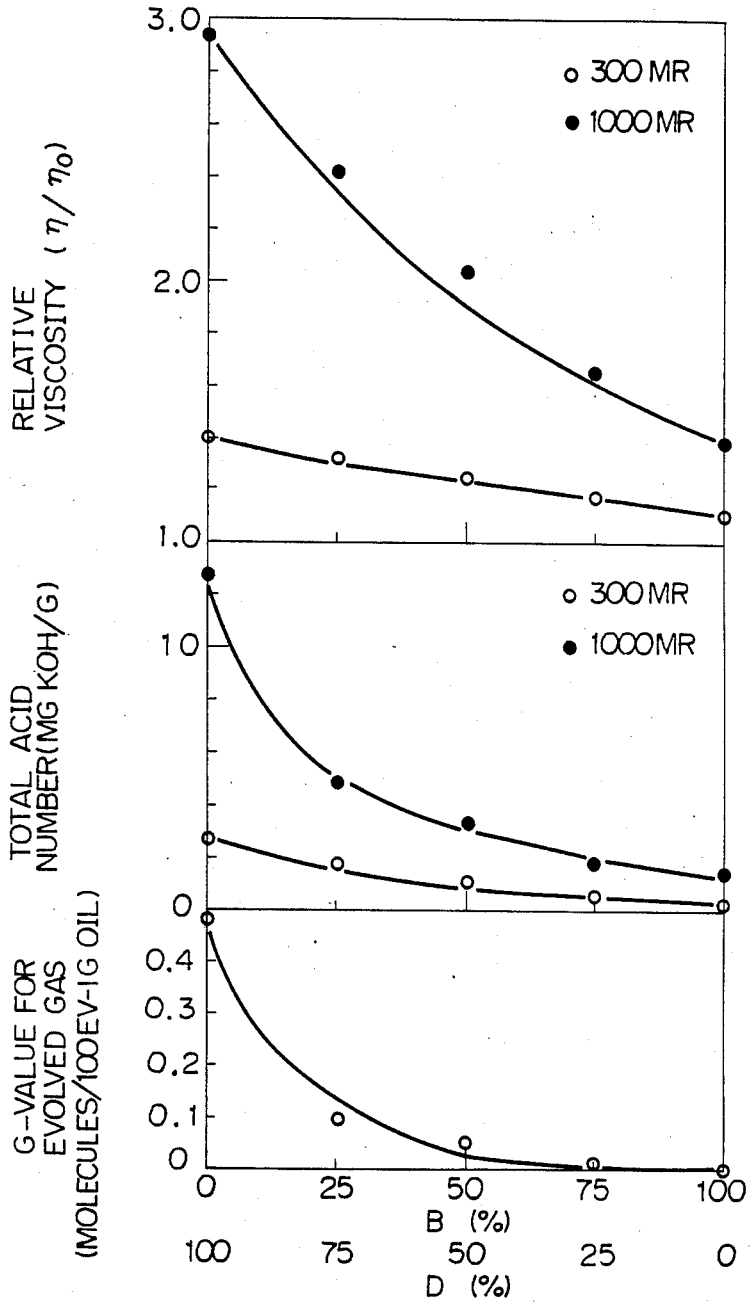
FIG. 2 shows the relationship between Examples 13 to 15 and Comparative Examples 1 to 6.
Figure 3:
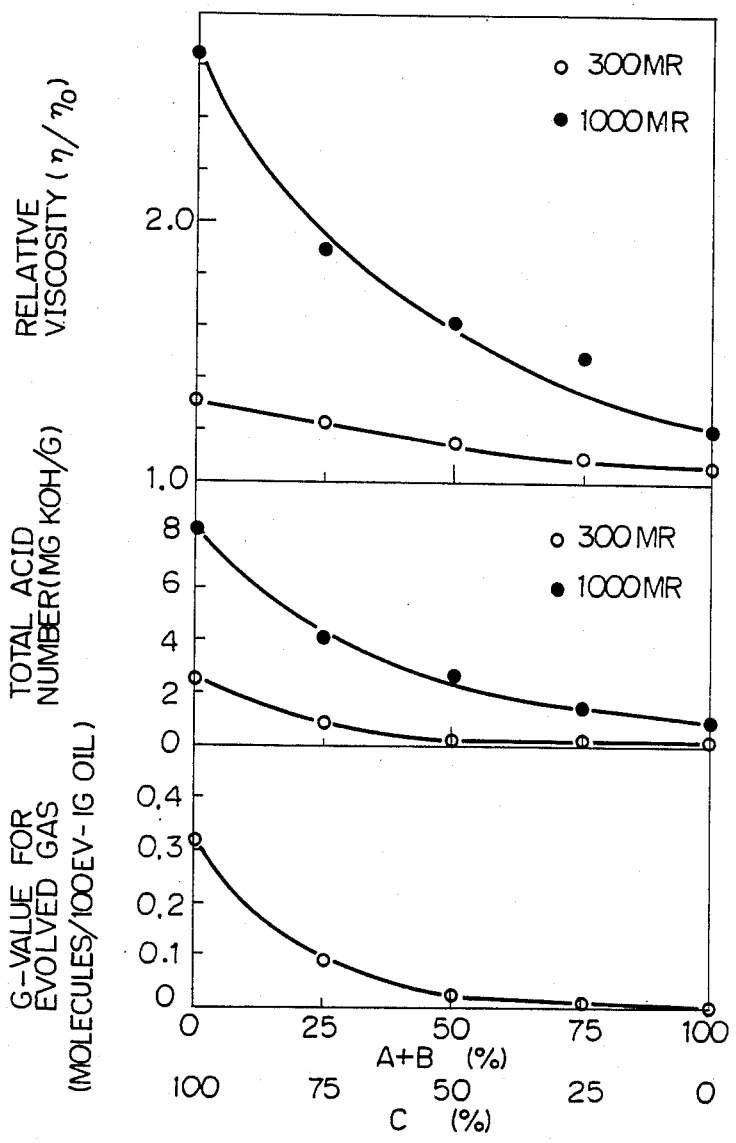
FIG. 3 shows the relationship between Examples 22 to 24 and Comparative Examples 8 and 3.
Figure 4:
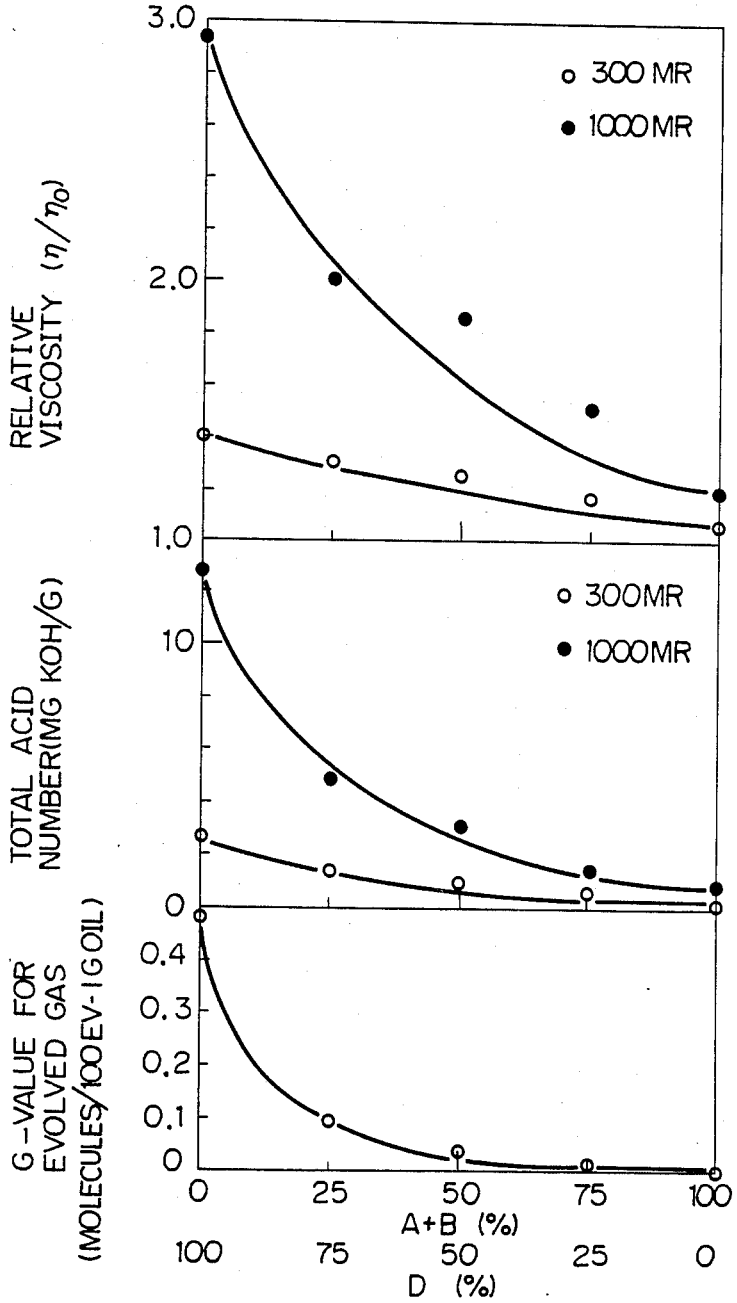
FIG. 4 shows the relationship between Examples 31 to 33 and Comparative Examples 8 and 6.

The lubricating oil blend of the present invention can be produced by mixing 25–75 wt% of a synthetic diphenylether oil with 75–25 wt% of a monoalkyldiphenyl ether or dialkyldiphenyl ether. The resulting lubricant is free from undesired phase separation and has a pour point not higher than 0° C. before and after irradiation. Further, the lubricant is highly resistant to ionizing radiation as applied in the presence of bubbled oxygen, and this advantage is proved by a very low G-value for the evolution of decomposition gases (≦0.1), and also by its stability in terms of viscosity and total acid number before and after irradiation.

One component of the lubricating oil of the present invention is the synthetic phenylether oil and this comprises 0–70 wt% of o-(m-phenoxyphenoxy)diphenyl and 100–30 wt% of m-(m-phenoxyphenoxy)diphenyl. If the respective amounts of the two diphenyls are 75–100 wt% and up to 25 wt%, they are not highly miscible with each other and o-(m-phenoxyphenoxy)diphenyl will come out of solution at room temperature. Furthermore, they are poorly miscible with the other component of the lubricating oil (i.e. monoalkyldiphenyl ether or dialkyldiphenyl ether) and cannot be mixed without causing phase separation.

The monoalkyldiphenyl ether or dialkyldiphenyl ether which is the other component of the lubricant oil blend of the present invention preferably has 10–20 carbon atoms in the alkyl moiety. If the alkyl group has less than 10 carbon atoms, the ether has low vapor pressure. If more than 20 carbon atoms are present in the alkyl group, the ether has an undesirably high pour point.

The resulting mixture primarily consisting of the phenoxyphenoxydiphenyl and the either monoalkyldiphenyl ether or dialkyldiphenyl ether has good lubricating properties and high resistance to ionizing radiation and therefore is expected to perform well as a lubricant for machines used in the radiation field.

The advantages of the present invention will become apparent by reading the following Working Examples 1 to 54 and Comparative Examples 1 to 21 given in the following Table.

An alkali metal salt of an m-phenylphenol/phenol mixture and m-dichlorobenzene was subjected to the Ullmann reaction in the presence of a copper catalyst. The reaction mixture was subjected to fractional distillation to obtain m-(m-phenoxyphenoxy)diphenyl. A diphenyl ether and an alpha-olefin (16 carbon atoms) were subjected to the Friedel-Crafts reaction in the presence of aluminum chloride, and the reaction mixture was subjected to fractional distillation to obtain a monoalkyldiphenyl ether (16 carbon atoms in the alkyl moiety) and dialkyldiphenyl ether (16 carbon atoms).

A mixture consisting of 75 wt% of the m-(m-phenoxyphenoxy)diphenyl and 25 wt% of the dialkyldiphenyl ether was prepared (Example 10).

Each of the other Working Examples and Comparative Examples in the Table was prepared by effecting a procedure similar to the above.

Each of the lubricating oil blends prepared was divided into two portions. One portion was irradiated with gamma-rays from Co-60 at a dose rate of 1 MR/hr to give a total dose of 300 MR. The other portion was given a total dose of 1,000 MR at the same rate. During the irradition, oxygen was blown at a flow rate of 250 ml/min. The viscosity, total acid number and pour point of each sample were measured both before and after the irradiation by the methods described in JIS* K 2283, 2501 and 2269, respectively. The results are shown in the Table, wherein the viscosity data for the irradiated samples is given in terms of the ratio of $\eta$, the viscosity of the sample after the irradiation to $\eta_0$, the initial viscosity. The G-value for the evolution of decomposition gases from each sample are also listed in the Table. The G-values were measured in terms of the pressure of decomposition gases evolving from the sample in an evacuated glass ampule that was irradiated with gamma-rays from Co-60.

The data in the following Table will reveal the advantages of the lubricating oil blends of the present invention: good lubricating properties and high resistance to ionizing radiation.

*JIS stands for Japanese Industrial Standard.

TABLE

| Ex. (Comp. Ex.) | Oil blends (wt %) A* | B** | C*** | D**** | Before irradiation: Viscosity $\eta_o$ cST(40° C.) | Total acid number mgKOH/g | Pour point °C. | After irradiation (300 MR): Relative viscosity $\eta/\eta_o$ | Total acid number mgKOH/g | Pour point °C. | After irradiation (1000 MR): Relative viscosity $\eta/\eta_o$ | Total acid number mgKOH/g | Pour point °C. | G-value for evolved gas |
|---|---|---|---|---|---|---|---|---|---|---|---|---|---|---|
| (1) | — | 100 | — | — | 124 | 0.00 | 2.5 | 1.11 | 0.34 | 2.5 | 1.38 | 1.54 | 2.5 | 0.005 |
| 1 | — | 75 | 25 (C: 10) | — | 70.0 | 0.00 | −20.0 | 1.19 | 0.82 | −20.0 | 1.67 | 2.72 | −20.0 | 0.008 |
| 2 | — | 50 | 50 (C: 10) | — | 38.4 | 0.00 | −45.0 | 1.20 | 1.02 | −45.0 | 1.70 | 3.00 | −45.0 | 0.015 |
| 3 | — | 25 | 75 (C: 10) | — | 21.3 | 0.00 | −55.0 | 1.26 | 1.12 | −50.0 | 1.85 | 3.68 | −45.0 | 0.036 |
| (2) | — | — | 100 (C: 10) | — | 11.8 | 0.00 | −57.5 | 1.33 | 1.50 | −50.0 | 2.10 | 5.00 | −45.0 | 0.080 |
| 4 | — | 75 | 25 (C: 16) | — | 80.2 | 0.00 | −12.5 | 1.18 | 0.92 | −12.5 | 1.75 | 3.02 | −12.5 | 0.011 |
| 5 | — | 50 | 50 (C: 16) | — | 52.0 | 0.00 | −27.5 | 1.23 | 1.21 | −27.5 | 1.99 | 4.02 | −27.5 | 0.029 |
| 6 | — | 25 | 75 (C: 16) | — | 33.2 | 0.00 | −35.0 | 1.27 | 1.52 | −35.0 | 2.21 | 5.05 | −35.0 | 0.09 |
| (3) | — | — | 100 (C: 16) | — | 21.2 | 0.00 | −40.0 | 1.30 | 2.40 | −37.5 | 2.64 | 8.10 | −35.0 | 0.32 |
| 7 | — | 75 | 25 (C: 20) | — | 90.2 | 0.00 | −5.0 | 1.21 | 0.83 | −5.0 | 1.70 | 2.75 | −5.0 | 0.009 |
| 8 | — | 50 | 50 (C: 20) | — | 65.3 | 0.00 | −15.0 | 1.30 | 1.10 | −15.0 | 2.00 | 3.86 | −15.0 | 0.025 |
| 9 | — | 25 | 75 (C: 20) | — | 47.4 | 0.00 | −12.5 | 1.38 | 1.52 | −12.5 | 2.24 | 5.05 | −12.5 | 0.10 |
| (4) | — | — | 100 (C: 20) | — | 34.2 | 0.00 | −10.0 | 1.55 | 3.36 | −7.5 | 2.83 | 11.2 | −7.5 | 0.60 |
| (1) | — | 100 | — | — | 124 | 0.00 | 2.5 | 1.11 | 0.34 | 2.5 | 1.38 | 1.54 | 2.5 | 0.005 |
| 10 | — | 75 | — | 25 (C: 10) | 96.0 | 0.00 | −12.5 | 1.19 | 0.82 | −12.5 | 1.68 | 2.72 | −12.5 | 0.009 |
| 11 | — | 50 | — | 50 (C: 10) | 74.4 | 0.00 | −30.0 | 1.27 | 1.10 | −30.0 | 1.96 | 3.65 | −30.0 | 0.025 |
| 12 | — | 25 | — | 75 (C: 10) | 58.5 | 0.00 | −47.5 | 1.35 | 1.50 | −45.0 | 2.18 | 5.01 | −42.5 | 0.08 |
| (5) | — | — | — | 100 (C: 10) | 47.7 | 0.00 | −50.0 | 1.38 | 3.24 | −45.0 | 2.74 | 10.8 | −40.0 | 0.275 |
| 13 | — | 75 | — | 25 (C: 16) | 112 | 0.00 | −2.5 | 1.17 | 0.60 | −2.5 | 1.66 | 1.85 | −2.5 | 0.01 |
| 14 | — | 50 | — | 50 (C: 16) | 102 | 0.00 | −10.0 | 1.25 | 1.12 | −10.0 | 2.04 | 3.37 | −10.0 | 0.05 |
| 15 | — | 25 | — | 75 (C: 16) | 94.0 | 0.00 | −10.0 | 1.32 | 1.64 | −10.0 | 2.42 | 4.93 | −7.5 | 0.10 |
| (6) | — | — | — | 100 (C: 16) | 84.8 | 0.00 | −10.0 | 1.40 | 2.69 | −10.0 | 2.94 | 12.2 | −5.0 | 0.48 |
| 16 | — | 75 | — | 25 (C: 20) | 135 | 0.00 | −5.0 | 1.26 | 0.89 | −5.0 | 1.89 | 3.00 | −5.0 | 0.013 |
| 17 | — | 50 | — | 50 (C: 20) | 142 | 0.00 | −12.5 | 1.31 | 1.30 | −12.5 | 2.00 | 4.41 | −10.0 | 0.049 |

TABLE-continued

| Ex. (Comp. Ex.) | Oil blends (wt %) A* | B** | C*** | D**** | Before irradiation: Viscosity $\eta_o$ cST(40° C.) | Total acid number mgKOH/g | Pour point °C. | After irradiation (300 MR): Relative viscosity $\eta/\eta_o$ | Total acid number mgKOH/g | Pour point °C. | After irradiation (1000 MR): Relative viscosity $\eta/\eta_o$ | Total acid number mgKOH/g | Pour point °C. | G-value for evolved gas |
|---|---|---|---|---|---|---|---|---|---|---|---|---|---|---|
| 18 | — | 25 | — | 75 (C: 20) | 152 | 0.00 | −10.0 | 1.49 | 2.45 | −7.5 | 2.66 | 8.20 | −5.0 | 0.10 |
| (7) | — | — | — | 100 (C: 20) | 160 | 0.00 | −5.0 | 1.72 | 4.20 | −2.5 | 3.40 | 14.0 | 5.0 | 0.60 |
| (8) | 50 | 50 | — | — | 190 | 0.00 | 2.5 | 1.06 | 0.20 | 2.5 | 1.20 | 0.84 | 2.5 | 0.005 |
| 19 | $50 \times \frac{75}{100}$ | $50 \times \frac{75}{100}$ | 25 (C: 10) | — | 92.0 | 0.00 | −25.0 | 1.09 | 0.25 | −25.0 | 1.47 | 1.21 | −25.0 | 0.008 |
| 20 | $50 \times \frac{50}{100}$ | $50 \times \frac{50}{100}$ | 50 (C: 10) | — | 47.2 | 0.00 | −50.0 | 1.12 | 0.30 | −50.0 | 1.52 | 2.10 | −50.0 | 0.014 |
| 21 | $50 \times \frac{25}{100}$ | $50 \times \frac{25}{100}$ | 75 (C: 10) | — | 23.3 | 0.00 | −57.5 | 1.23 | 0.74 | −55.0 | 1.63 | 2.72 | −50.0 | 0.036 |
| (2) | — | — | 100 (C: 10) | — | 11.8 | 0.00 | −57.5 | 1.33 | 1.50 | −50.0 | 2.10 | 5.00 | −45.0 | 0.080 |
| 22 | $50 \times \frac{75}{100}$ | $50 \times \frac{75}{100}$ | 25 (C: 16) | — | 112 | 0.00 | −15.0 | 1.10 | 0.27 | −15.0 | 1.48 | 1.50 | −15.0 | 0.010 |
| 23 | $50 \times \frac{50}{100}$ | $50 \times \frac{50}{100}$ | 50 (C: 16) | — | 64.1 | 0.00 | −30.0 | 1.15 | 0.34 | −30.0 | 1.62 | 2.71 | −30.0 | 0.028 |
| 24 | $50 \times \frac{25}{100}$ | $50 \times \frac{25}{100}$ | 75 (C: 16) | — | 37.2 | 0.00 | −37.5 | 1.23 | 0.82 | −37.5 | 1.90 | 4.03 | −35.0 | 0.09 |
| (3) | — | — | 100 (C: 16) | — | 21.2 | 0.00 | −40.0 | 1.30 | 2.40 | −37.5 | 2.64 | 8.10 | −35.0 | 0.32 |
| 25 | $50 \times \frac{75}{100}$ | $50 \times \frac{75}{100}$ | 25 (C: 20) | — | 125 | 0.00 | −5.0 | 1.15 | 0.62 | −5.0 | 1.51 | 2.15 | −5.0 | 0.009 |
| 26 | $50 \times \frac{50}{100}$ | $50 \times \frac{50}{100}$ | 50 (C: 20) | — | 81.0 | 0.00 | −17.5 | 1.25 | 0.90 | −17.5 | 1.82 | 3.30 | −17.5 | 0.024 |
| 27 | $50 \times \frac{25}{100}$ | $50 \times \frac{25}{100}$ | 75 (C: 20) | — | 52.4 | 0.00 | −15.0 | 1.30 | 1.41 | −15.0 | 2.00 | 4.52 | −15.0 | 0.10 |
| (4) | — | — | 100 (C: 20) | — | 34.2 | 0.00 | −10.0 | 1.55 | 3.36 | −7.5 | 2.83 | 11.2 | −7.5 | 0.60 |
| (8) | 50 | 50 | — | — | 190 | 0.00 | 2.5 | 1.06 | 0.20 | 2.5 | 1.20 | 0.84 | 2.5 | 0.005 |
| 28 | $50 \times \frac{75}{100}$ | $50 \times \frac{75}{100}$ | — | 25 (C: 10) | 137 | 0.00 | −17.5 | 1.14 | 0.60 | −17.5 | 1.50 | 1.62 | −17.5 | 0.009 |

TABLE-continued

| Ex. (Comp. Ex.) | Oil blends (wt %) A* | B** | C*** | D**** | Before irradiation: Viscosity $\eta_o$ cST(40° C.) | Total acid number mgKOH/g | Pour point °C. | After irradiation (300 MR): Relative viscosity $\eta/\eta_o$ | Total acid number mgKOH/g | Pour point °C. | After irradiation (1000 MR): Relative viscosity $\eta/\eta_o$ | Total acid number mgKOH/g | Pour point °C. | G-value for evolved gas |
|---|---|---|---|---|---|---|---|---|---|---|---|---|---|---|
| 29 | $50 \times \frac{50}{100}$ | $50 \times \frac{50}{100}$ | — | 50 (C: 10) | 92.6 | 0.00 | −37.5 | 1.23 | 0.87 | −37.5 | 1.79 | 2.81 | −37.5 | 0.022 |
| 30 | $50 \times \frac{25}{100}$ | $50 \times \frac{25}{100}$ | — | 75 (C: 10) | 66.0 | 0.00 | −50.0 | 1.27 | 1.30 | −47.5 | 1.96 | 4.30 | −45.0 | 0.08 |
| (5) | — | — | — | 100 (C: 10) | 47.7 | 0.00 | −50.0 | 1.38 | 3.24 | −45.0 | 2.74 | 10.8 | −40.0 | 0.275 |
| 31 | $50 \times \frac{75}{100}$ | $50 \times \frac{75}{100}$ | — | 25 (C: 16) | 156 | 0.00 | −12.5 | 1.17 | 0.66 | −12.5 | 1.52 | 1.61 | −12.5 | 0.012 |
| 32 | $50 \times \frac{50}{100}$ | $50 \times \frac{50}{100}$ | — | 50 (C: 16) | 128 | 0.00 | −17.5 | 1.25 | 0.98 | −17.5 | 1.86 | 3.20 | −17.5 | 0.038 |
| 33 | $50 \times \frac{25}{100}$ | $50 \times \frac{25}{100}$ | — | 75 (C: 16) | 103 | 0.00 | −15.0 | 1.30 | 1.51 | −15.0 | 2.01 | 4.88 | −12.5 | 0.098 |
| (6) | — | — | — | 100 (C: 16) | 84.8 | 0.00 | −10.0 | 1.40 | 2.69 | −10.0 | 2.94 | 12.7 | −5.0 | 0.48 |
| 34 | $50 \times \frac{75}{100}$ | $50 \times \frac{75}{100}$ | — | 25 (C: 20) | 182 | 0.00 | −7.5 | 1.20 | 0.77 | −7.5 | 1.52 | 2.50 | −7.5 | 0.014 |
| 35 | $50 \times \frac{50}{100}$ | $50 \times \frac{50}{100}$ | — | 50 (C: 20) | 174 | 0.00 | −15.0 | 1.29 | 1.10 | −15.0 | 1.96 | 4.30 | −12.5 | 0.05 |
| 36 | $50 \times \frac{25}{100}$ | $50 \times \frac{25}{100}$ | — | 75 (C: 20) | 168 | 0.00 | −10.0 | 1.43 | 2.02 | −7.5 | 2.44 | 6.56 | −5.0 | 0.10 |
| (7) | — | — | — | 100 (C: 20) | 160 | 0.00 | −5.0 | 1.72 | 4.20 | −2.5 | 3.40 | 14.0 | 5.0 | 0.60 |
| (9) | 70 | 30 | — | — | 200 | 0.00 | 2.5 | 1.07 | 0.22 | 2.5 | 1.24 | 0.89 | 2.5 | 0.005 |
| 37 | $70 \times \frac{75}{100}$ | $30 \times \frac{75}{100}$ | 25 (C: 10) | — | 97.0 | 0.00 | −15.0 | 1.12 | 0.42 | −15.0 | 1.53 | 1.43 | −15.0 | 0.008 |
| 38 | $70 \times \frac{50}{100}$ | $30 \times \frac{50}{100}$ | 50 (C: 10) | — | 47.8 | 0.00 | −42.5 | 1.17 | 0.65 | −42.5 | 1.61 | 2.52 | −42.5 | 0.015 |
| 39 | $70 \times \frac{25}{100}$ | $30 \times \frac{25}{100}$ | 75 (C: 10) | — | 23.2 | 0.00 | −50.0 | 1.25 | 1.00 | −47.5 | 1.70 | 3.02 | −42.5 | 0.036 |
| (2) | — | — | 100 (C: 10) | — | 11.8 | 0.00 | −57.5 | 1.33 | 1.50 | −50.0 | 2.10 | 5.00 | −45.0 | 0.080 |

TABLE-continued

| Ex. (Comp. Ex.) | Oil blends (wt %) A* | B** | C*** | D**** | Before irradiation: Viscosity $\eta_o$ cST(40° C.) | Total acid number mgKOH/g | Pour point °C. | After irradiation (300 MR): Relative viscosity $\eta/\eta_o$ | Total acid number mgKOH/g | Pour point °C. | After irradiation (1000 MR): Relative viscosity $\eta/\eta_o$ | Total acid number mgKOH/g | Pour point °C. | G-value for evolved gas |
|---|---|---|---|---|---|---|---|---|---|---|---|---|---|---|
| 40 | $70 \times \frac{75}{100}$ | $30 \times \frac{75}{100}$ | 25 (C: 16) | — | 116 | 0.00 | −10.0 | 1.13 | 0.31 | −10.0 | 1.60 | 1.73 | −10.0 | 0.010 |
| 41 | $70 \times \frac{50}{100}$ | $30 \times \frac{50}{100}$ | 50 (C: 16) | — | 66.0 | 0.00 | −25.0 | 1.19 | 0.55 | −25.0 | 1.83 | 3.30 | −25.0 | 0.029 |
| 42 | $70 \times \frac{25}{100}$ | $30 \times \frac{25}{100}$ | 75 (C: 16) | — | 37.6 | 0.00 | −32.5 | 1.26 | 1.03 | −32.5 | 2.02 | 4.32 | −30.0 | 0.09 |
| (3) | — | — | 100 (C: 16) | — | 21.2 | 0.00 | −40.0 | 1.30 | 2.40 | −37.5 | 2.64 | 8.10 | −35.0 | 0.32 |
| 43 | $70 \times \frac{75}{100}$ | $30 \times \frac{75}{100}$ | 25 (C: 20) | — | 130 | 0.00 | −5.0 | 1.18 | 0.65 | −5.0 | 1.58 | 2.30 | −5.0 | 0.009 |
| 44 | $70 \times \frac{50}{100}$ | $30 \times \frac{50}{100}$ | 50 (C: 20) | — | 84.0 | 0.00 | −12.5 | 1.27 | 1.02 | −12.5 | 1.89 | 3.51 | −12.5 | 0.025 |
| 45 | $70 \times \frac{25}{100}$ | $30 \times \frac{25}{100}$ | 75 (C: 20) | — | 53.8 | 0.00 | −10.0 | 1.33 | 1.45 | −10.0 | 2.11 | 4.80 | −10.0 | 0.10 |
| (4) | — | — | 100 (C: 20) | — | 34.2 | 0.00 | −10.0 | 1.55 | 3.36 | −7.5 | 2.83 | 11.2 | −7.5 | 0.60 |
| (9) | 70 | 30 | — | — | 200 | 0.00 | 2.5 | 1.07 | 0.22 | 2.5 | 1.24 | 0.89 | 2.5 | 0.005 |
| 46 | $70 \times \frac{75}{100}$ | $30 \times \frac{75}{100}$ | — | 25 (C: 10) | 141 | 0.00 | −10.0 | 1.16 | 0.64 | −10.0 | 1.56 | 2.26 | −10.0 | 0.009 |
| 47 | $70 \times \frac{50}{100}$ | $30 \times \frac{50}{100}$ | — | 50 (C: 10) | 98.2 | 0.00 | −27.5 | 1.25 | 0.95 | −27.5 | 1.82 | 3.10 | −27.5 | 0.024 |
| 48 | $70 \times \frac{25}{100}$ | $30 \times \frac{25}{100}$ | — | 75 (C: 10) | 58.0 | 0.00 | −45.0 | 1.30 | 1.35 | −42.5 | 2.03 | 4.56 | −40.0 | 0.08 |
| (5) | — | — | — | 100 (C: 10) | 47.7 | 0.00 | −50.0 | 1.38 | 3.24 | −45.0 | 2.74 | 10.8 | −40.0 | 0.275 |
| 49 | $70 \times \frac{75}{100}$ | $30 \times \frac{75}{100}$ | — | 25 (C: 16) | 164 | 0.00 | −7.5 | 1.18 | 0.70 | −7.5 | 1.57 | 1.72 | −7.5 | 0.012 |
| 50 | $70 \times \frac{50}{100}$ | $30 \times \frac{50}{100}$ | — | 50 (C: 16) | 131 | 0.00 | −12.5 | 1.27 | 1.02 | −12.5 | 1.90 | 3.30 | −12.5 | 0.039 |
| 51 | $70 \times \frac{25}{100}$ | $30 \times \frac{25}{100}$ | — | 75 (C: 16) | 105 | 0.00 | −10.0 | 1.32 | 1.63 | −10.0 | 2.06 | 4.90 | −7.5 | 0.098 |
| (6) | — | — | — | 100 | 84.8 | 0.00 | −10.0 | 1.40 | 2.69 | −10.0 | 2.94 | 12.7 | −5.0 | 0.48 |

TABLE-continued

| Ex. (Comp. Ex.) | Oil blends (wt %) A* | B** | C*** | D**** | Before irradiation: Viscosity $\eta_o$ cST(40° C.) | Total acid number mgKOH/g | Pour point °C. | After irradiation (300 MR): Relative viscosity $\eta/\eta_o$ | Total acid number mgKOH/g | Pour point °C. | After irradiation (1000 MR): Relative viscosity $\eta/\eta_o$ | Total acid number mgKOH/g | Pour point °C. | G-value for evolved gas |
|---|---|---|---|---|---|---|---|---|---|---|---|---|---|---|
| | | | | (C: 16) | | | | | | | | | | |
| 52 | $70 \times \frac{75}{100}$ | $30 \times \frac{75}{100}$ | — | 25 (C: 20) | 190 | 0.00 | −2.5 | 1.22 | 0.83 | −2.5 | 1.65 | 2.65 | −2.5 | 0.014 |
| 53 | $70 \times \frac{50}{100}$ | $30 \times \frac{50}{100}$ | — | 50 (C: 20) | 182 | 0.00 | −7.5 | 1.30 | 1.16 | −7.5 | 1.98 | 4.36 | −5.0 | 0.05 |
| 54 | $70 \times \frac{25}{100}$ | $30 \times \frac{25}{100}$ | — | 75 (C: 20) | 171 | 0.00 | −7.5 | 1.45 | 2.15 | −5.0 | 2.51 | 6.94 | −2.5 | 0.10 |
| (7) | — | — | — | 100 (C: 20) | 160 | 0.00 | −5.0 | 1.72 | 4.20 | −2.5 | 3.40 | 14.0 | 5.0 | 0.60 |
| (1) | — | 100 | — | — | 124 | 0.00 | 2.5 | 1.11 | 0.34 | 2.5 | 1.38 | 1.54 | 2.5 | 0.005 |
| (11) | 80 | 20 | — | — | A' crystals were deposited. | | | | | | | | | |
| (12) | 75 | 25 | — | — | A' crystals were deposited. | | | | | | | | | |
| (13–15) | $75 \times \frac{(75-25)}{100}$ | $25 \times \frac{(75-25)}{100}$ | 25–75 | — | A' crystals were deposited. | | | | | | | | | |
| (16–18) | $75 \times \frac{(75-25)}{100}$ | $25 \times \frac{(75-25)}{100}$ | — | 25–75 | Two phases separated. | | | | | | | | | |
| (19) | 100 | — | — | — | A' melting point is 50—50° C. | | | | | | | | | |
| (20) | — | — | — | *E 100 | — | — | 30< | — | — | | — | — | | 0.025 |
| (21) | — | 50 | — | *E 50 | E* was deposited and has no compatibility with b. | | | | | | | | | |

*"A" means o-(m-phenoxyphenoxy)diphenyl.
**"B" means m-(m-phenoxyphenoxy)diphenyl.
***"C" means a monoalkyldiphenyl ether.
****"D" means a dialkyldiphenyl ether.
C: 10, C: 16 and C: 20 means 10, 16 and 20 carbon atoms, repsectively.
*"E" means a bis[p-(p-α-cumylphenoxy)phenyl]ether disclosed in U.S. Pat. No. 3,203,997.

What is claimed is:

1. A lubricating oil blend having resistance to ionizing radiation comprising the following components:

(a) 25 to 75% by weight of a mixture of 0–70% by weight of o-(m-phenoxyphenoxy)diphenyl and 100–30% by weight of m-(m-phenoxyphenoxy)-diphenyl; and (b) 75 to 25% by weight of a monoalkyldiphenyl ether or dialkyldiphenyl ether;

said blends having a pour point of not higher than 0° C. before and after irradiation, and a G-value of 0.1 or below for the evolution of decomposition gases under irradiation with ionizing radiation; and said monoalkyldiphenyl ether or dialkyldiphenyl ether having 10 to 20 carbon atoms in the alkyl moiety.

2. A lubricating oil blend according to claim 1 wherein said blend comprises the following components:

(a) 25 to 75% by weight of m-(m-phenoxyphenoxy)-diphenyl; and (b) 75 to 25% by weight of a monoalkyldiphenyl ether.

3. A lubricating oil blend according to claim 1 wherein said blend comprises the following components:

(a) 25 to 75% by weight of m-(m-phenoxyphenoxy)-diphenyl; and (b) 75 to 25% by weight of a dialkyldiphenyl ether.

4. A lubricating oil blend according to claim 1 wherein said blend comprises the following components:

(a) 25 to 75% by weight of a mixture of up to 70% by weight of o-(m-phenoxyphenoxy)diphenyl and 30% by weight or more of m-(m-phenoxyphenoxy)diphenyl; and (b) 75 to 25% by weight of a monoalkyldiphenyl ether.

5. A lubricating oil blend according to claim 1 wherein said blend comprises the following components:

(a) 25 to 75% by weight of a mixture of up to 70% by weight of o-(m-phenoxyphenoxy)diphenyl and 30% by weight or more or m-(m-phenoxyphenoxy)diphenyl and (b) 75 to 25% by weight of a dialkyldiphenyl ether.

* * * * *